United States Patent [19]

Hamelin et al.

[11] 4,138,975

[45] Feb. 13, 1979

[54] CONTROL DEVICE FOR CARBURETOR

[75] Inventors: Gilbert Hamelin, Marly La Ville; Louis Monpetit, Foncquevillers, both of France

[73] Assignee: Societe Anonyme DBA, Paris, France

[21] Appl. No.: 673,184

[22] Filed: Apr. 2, 1976

[30] Foreign Application Priority Data

Jan. 16, 1976 [FR] France ..... 76 01077

[51] Int. Cl.[2] ..... F02D 11/10; F02M 39/00

[52] U.S. Cl. ..... 123/102; 123/139 E

[58] Field of Search ..... 123/102, 139 E

[56] References Cited

U.S. PATENT DOCUMENTS

| | | | |
|---|---|---|---|
| 4,029,068 | 6/1977 | Jones et al. | 123/139 E |
| 4,033,314 | 7/1977 | Walton | 123/139 E |

*Primary Examiner*—Samuel W. Engle
*Assistant Examiner*—Thomas H. Webb
*Attorney, Agent, or Firm*—Ken C. Decker; William N. Antonis

[57] ABSTRACT

A control circuit for delivering control signals to interrupt admission of the fuel-air mixture in the low speed and idle circuit of the carburetor of an internal combustion engine. The control circuit is operated according to the engine operating conditions. The control signal is delivered in response to comparison of a signal whose level is representative of the amplitude of the variations, i.e., the absolute value of the variations in the duration of an engine cycle, with a substantially periodic signal to generate a pulse-shaped signal. The pulses have a relatively narrow width when the amplitude of the variations is great, and a larger width when the amplitude of the variations is smaller.

20 Claims, 13 Drawing Figures

CONTROL DEVICE FOR CARBURETOR

The invention relates to a method of controlling the admission of the air-fuel mixture to an internal combustion engine, and more particularly to the idle and low speed circuit of a carburetor mounted on said engine.

The invention also relates to a control circuit for a carburetor, for carrying out this method.

Generally, it concerns a device intended to act by means of an electronic circuit so as to limit the admission of fuel to an internal combustion engine to a rate just sufficient to prevent the engine from tending to rotate excessively irregularly.

More particularly, the invention is of the type comprising an electronic device for controlling the admission of the air-fuel mixture to the idle and low speed circuit of the carburetor of an internal combustion engine, so as to effect cutoffs of admission whose duration is the shorter, the greater is the irregularity of the engine.

Consequently, an engine with a perfectly adjusted carburetor, that is, one which already has a sufficiently poor mixture and which is already rotating irregularly, will operate so that the cut-offs of admission will be of relatively short duration. However, for an engine whose carburetor is receiving too rich a mixture, i.e. which is rotating regularly with a low degree of irregularity, the electronic device will effect more numerous cutoffs of rather large duration.

The invention proposes a method of controlling the admission of the air-fuel mixture to an internal combustion engine, consisting in interrupting substantially periodically the admission of the air-fuel mixture to the idle and low speed circuit of a carburetor of an internal combustion engine for durations which are the shorter, the greater is the absolute value of the variation in duration of all or part of an engine cycle or of a plurality of successive engine cycles.

The invention also proposes a control circuit for controlling the admission of air-fuel mixture to the idle and low speed circuit of a carburetor, for carrying out the method mentioned above, the control circuit comprising means for generating a first signal representative of the amplitude of the variations in the duration of the period of a cycle of the engine, and means responsive to said first signal for delivering a control signal for interrupting admission of the air-fuel mixture, said control signal having a duration which is a decreasing function of said first signal.

According to a preferred embodiment of the invention, the control circuit comprises a comparator of which a first input is adapted to receive a first signal whose amplitude substantially represents the amplitude of the difference between the durations of two successive periods, i.e. the absolute value of said difference, and of which a second input can receive a second signal having a substantially periodic law of variation, the comparator being arranged to deliver the control signal between two instants in a single period of the second signal, at which the second signal is equal in value to the first signal.

An advantage of the present invention is that it permits to obtain a reduction in the consumption of fuel and also in the exhaust of carbon monoxide with a consequent reduction in the pollution caused by the vehicle.

The invention will be better understood and other advantages will become apparent from the ensuing description referring to the accompanying drawings, in which:

FIG. 1 diagrammatically illustrates a carburetor for an internal combustion engine designed to be controlled by an electronic device embodying the invention;

Figure 1:
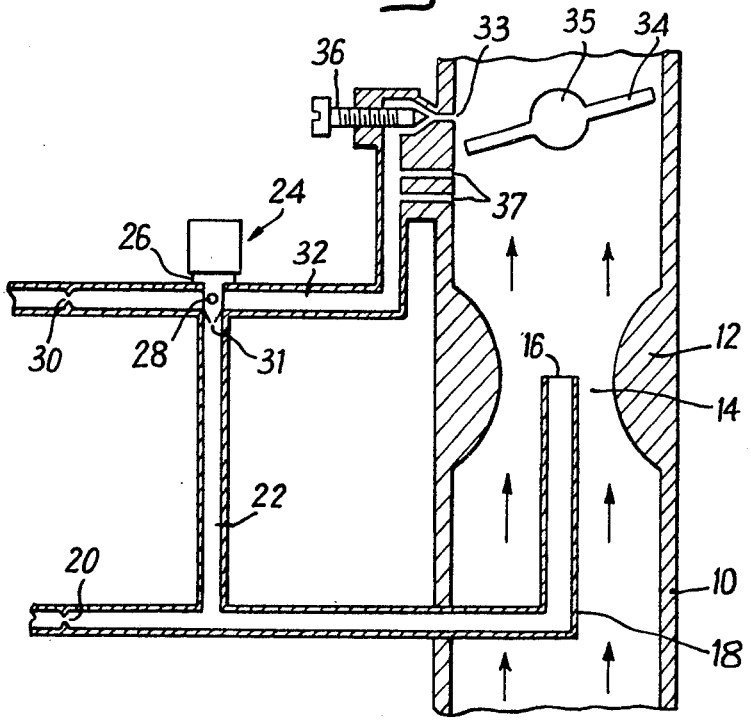

FIG. 1 is a diagrammatic illustration of a carburetor in which the air supplied to the engine flows through a casing 10 as indicated by arrows (from the bottom upwards in the drawing). The casing 10 has a venturi 12 with a throat 14 containing the main feed device, in the form of an atomizer 16 supplied by a pipe 18, which in turn is supplied from a float chamber (not shown) by way of a jet 20 (the main jet). A by-pass 22, disposed downstream of the jet 20, supplies an idling or low speed and progression circuit by way of an idling jet generally designated 24. This jet has a casing 26 with holes 28 which enable air from an additional calibrated inlet 30 to mix with the fuel from the by-pass 22 by way of an orifice 31 in the "nozzle" of the jet 24. The emulsion so produced is passed along a pipe 32 to an idling orifice 33, downstream of a throttle 34 which can turn on a pivot 35 perpendicular to the axis of the casing 10. The orifice 33 is adjustable by means of a mixture screw 36. The pipe 32 also supplies two progression holes 37.

In accordance with the invention, the idling jet 24 is replaced with a miniature solenoid valve having satisfactory response characteristics at high frequencies. This valve is alternately open or closed, the frequency of its movements and/or the time intervals during which it is maintained "open" or "closed" being determined by an external electronic device controlled according to the values of different parameters of the engine operating characteristics.

Figure 2:
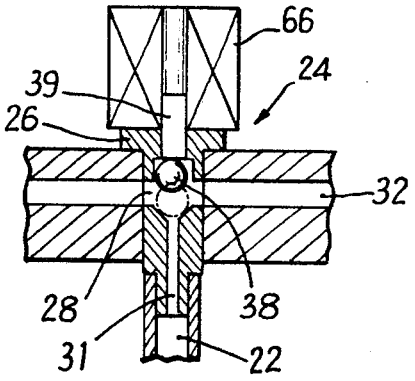
FIG. 2 is a diagrammatic axial section representing the fitting of a miniature solenoid valve to the carburetor shown in FIG. 1 for the purpose of electronic control of the carburetor.

FIG. 2 is a schematic illustration of the miniature solenoid valve connected between the pipes 22 and 32. This solenoid valve is adapted to control mixture of air and fuel in the low speed circuit. It comprises a ball valve 38 which normally adheres to the end of a magnet core 39, in a position remote from an orifice 31 communicating pipes 22 and 32. It also comprises a coil 66 surrounding the magnet core 33 so as to repel the ball valve member 38 against a seat in the orifice 31, for blocking communication between pipes 22 and 32, when coil 66 is energized, but still maintaining some air supply to the pipe 32.

Figure 3:
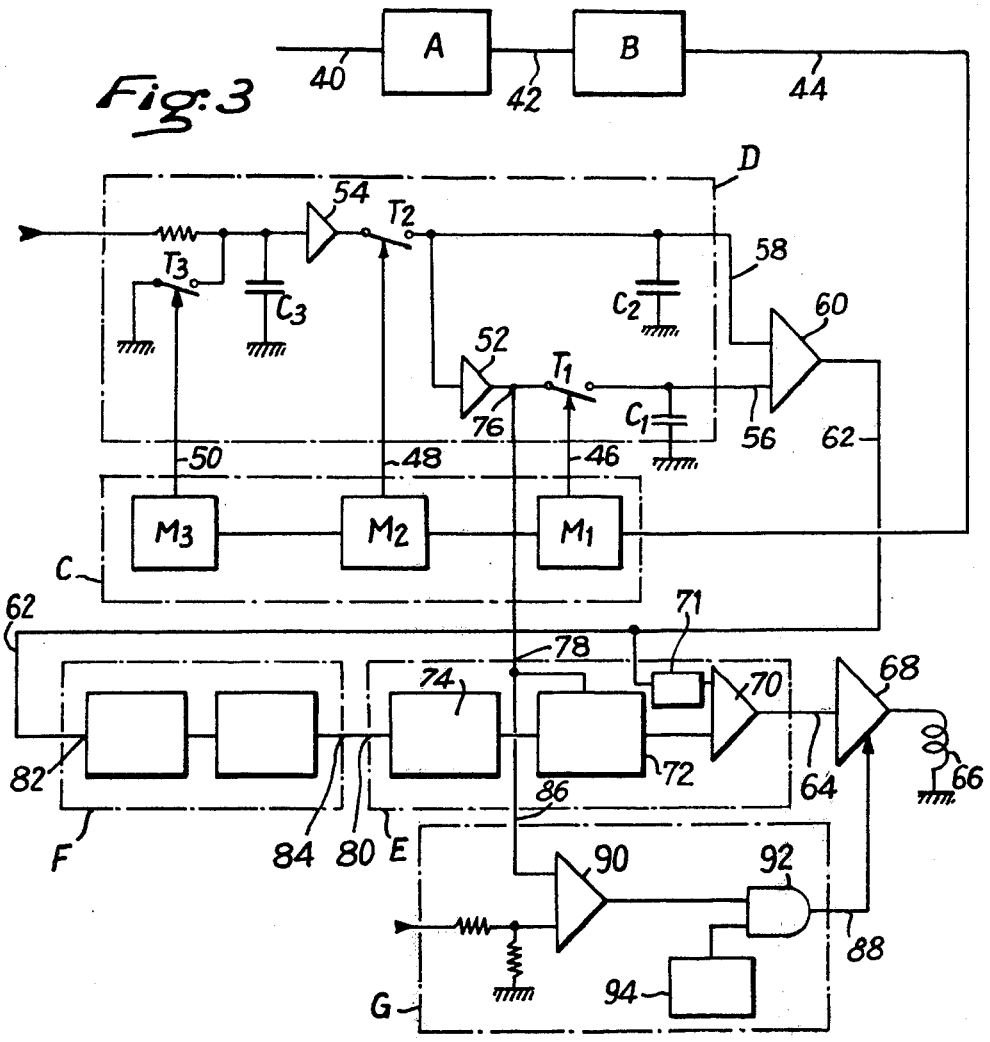
FIG. 3 is a circuit diagram of the electronic device embodying the invention.

FIG. 3 is a circuit diagram representing the electronic device which controls the closure of the solenoid valve controlling the admission of a fraction of the air/fuel mixture to the internal combustion engine. Reference 40 designates an electrical connection from the wire connecting the platinum tipped screws and ignition coil to the input of a circuit generally designated A. The circuit A is a sharper circuit for the information received at the connection 40 and permits elimination of superimposed oscillations induced by the operation of the ignition coil. The output of the circuit A is linked by a connection 42 to a frequency divider circuit B whose role is explained below. For the understanding of operation of the device, it is sufficient to say that the frequency divider supplies to a connection 44 an output signal whose period equals the duration of an engine cycle (or a multiple or submultiple of the duration of the cycle).

In the embodiment described below, the signal at the connection 44 has a period equal to the duration of an engine cycle.

The connection 44 is connected to the input of a circuit C comprising three monostable circuits M1, M2, M3 arranged in series. The three monostable circuits are identical in structure and are designed to deliver successively at their respective output terminals 46, 48 and 50 a first, second and third positive closing signals, whose roles will be explained below. The first, second and third closing signals are mutually exclusive, that is to say, at most one of the three closing signals is generated at the same time.

The circuit C is connected to a circuit D comprising three input terminals with respective connections to the output terminals 46, 48 and 50. The circuit D comprises first, second and third storage elements C1, C2 and C3 respectively, in the form of capacitors. Between the storage elements C2 and C1 there is a coupling amplifier 52 having a unity gain disposed in series with a normally open switch T1. Closure of the switch T1 is effected by the first closing signal from the output terminal 46 of the monostable circuit M1. In response to closure of the switch T1, the charge stored in the storage element C2 is transferred to the storage element C1. Similarly, a coupling amplifier 54 having a unity gain and a normally open switch T2 are provided between the storage elements C3 and C2. Closure of the switch T2 is effected upon generation of the second closure signal from the output terminal 48 of the monostable circuit M2. In response to closure of the switch T2, the value of the charge of the storage element C3 at that instant is transferred to the storage element C2. Charging of the storage element C3 is effected according to a predetermined law, and the element is reset to zero periodically by the closure of a normally open switch T3. The switch T3 closes in response to the appearance of a third closing signal at the output terminal 50 of the monostable circuit M3. During operation, the monostable circuit M1 is triggered periodically by the signal appearing at the connection 44, and the interval between each triggering corresponds to the period (or a multiple or submultiple) of the engine cycle. The trailing edge of the signal at the output from the monostable circuit M1 triggers the monostable circuit M2, and the trailing edge of the signal at the ouptut from the monostable circuit M2 triggers the monostable circuit M3. Thus the closing signals at the output terminals 46, 48 and 50 are delivered successively, so that the switches T1, T2 and T3 are closed in that order and at most one switch at a time is in the closed position. As a result the operation of the circuit C at the end of an engine cycle produces the following sequence:

(a) closure of the switch T1 and transfer of the charge from the storage element C2 to the storage element C1;
(b) opening of the switch T1;
(c) closure of the switch T2 and transfer of the charge from the storage element C3 to the storage element C2;
(d) opening of the switch T2;
(e) closure of the switch T3 and simultaneous zero resetting of the charge in the storage element C3;
(f) opening of the switch T3, from which moment the storage element C3 begins to recharge according to the predetermined law.

It should be noted that the periodicity of the various closing signals corresponds to an engine cycle (or a multiple or a submultiple thereof). In the description to follow, the occurrence of the closing signals will correspond to the period of an engine cycle, that is two turns in the case of a four cylinder engine. The value of the charge transferred from the storage element C3 to the element C2 represents the time interval between the delivery of a third closing signal corresponding to the end of a given cycle to reset the storage element C3 to zero, and the delivery of the second closure signal for the following cycle to transfer the charge from the storage element C3 to the storage element C2. Consequently, the value of the charge transferred to the storage element C2 substantially represents the duration of a period of an engine cycle (with the exception of the duration of the third closing pulse). Similarly, the value of the charge transferred to the storage element C1 represents the period of the preceding engine cycle.

The first, second and third closing signals are substantially equal in duration, but their duration is negligible relative to the time which elapses between two triggerings of the monostable circuit M1.

The informations contained in the storage elements C1, C2 respectively represent the duration of the periods of two successive engine cycles, that is to say, the respective average speeds of rotation of the engine during these two successive cycles. The charges stored in the storage elements C1 and C2 are delivered at the output terminals 56, 58 respectively of the circuit D. The terminals 56, 58 are connected to respective input terminals of a differential amplifier 60, which supplies at its output terminal 62 a signal whose amplitude is a function of the difference between the charges stored in the storage elements C2 and C1. The amplitude of the signal at the output terminal 62 therefore is representative of the variations in the duration of the periods of an engine cycle for two successive engine cycles. The output terminal 62 of the differential amplifier 60 is connected to one input of a control circuit generally designated E, whose output terminal 64 supplies a control signal to the solenoid valve 66 so that it interrupts the admission of fuel to the idling jet 24. The solenoid valve is controlled by way of a power amplifier 68. The control circuit E comprises four circuits 70, 71, 72 and 74 whose roles will be explained below. For the present understanding, it is sufficient to state that the control signals delivered by the circuit E are substantially periodic pulses whose duration varies inversely with the amplitude of the variations of the duration of an engine cycle or part of an engine cycle, or a plurality of successive engine cycles. In the embodiment described below, the division factor of the divider B is equal to four, and the variation in duration of a complete engine cycle is measured (as will be explained). However, the division factor of the divider B could be an integral multiple or submultiple of four without departing from the scope of the invention.

The output terminal 76 of the coupling amplifier 52 of the circuit D is connected to an input terminal 78 of the control circuit E. The value of the signal at the output 76 of the coupling amplifier 52, that is, the value of the charge in the storage element C2, represents the duration of the last measured period of the engine cycle. The control circuit E, more particularly the subcircuit 72, is responsive to the value of the signal at the output from the amplifier 52, so that the duration of the interruption of admission, i.e. the duration of the control signal decreases as a function of the duration of the period of the engine cycle, that is, increases as a function of the rotational speed of the engine. A correcting circuit F comprises an input terminal 82 connected to the output terminal 62 of the comparator 60 and an output terminal 84 connected to another input terminal 80 of the control means E. The correcting circuit F responds to both the number and amplitude of the increases in duration of the period of the engine cycle, to act on the control means E. The circuit F generates at output 84 a signal which is a function of the occurrence and amplitude in the increase of the signal on terminal 62. The circuit E receives the signal from terminal 84 so that the duration of the control signal is an increasing function of the occurrence and amplitude of the positive variation of signal at terminal 62. Details of the correcting circuit F will be given subsequently.

The electronic device comprises a circuit G with an input terminal 86 and an output terminal 88. Tthe circuit G is hereinafter termed the cutoff circuit. The input terminal 86 is connected to the output terminal 76 of the coupling amplifier 52, which delivers a signal whose value equals the charge in the storage element C2, representing the duration of the last measured period of the engine cycle. The input terminal 86 is connected to one input of a comparator 90, whose other input is maintained at a constant potential representing a predetermined duration of the period of the engine cycle. The circuit G also comprises an AND gate 92 with two inputs, of which one is connected to a device 94 responsive to the depression downstream of the throttle whereas the other is connected to the output of the comparator 90. The AND gate 92 delivers a control signal at the output terminal 88 of the circuit G when two conditions are fulfilled: firstly, the depression downstream the throttle exceeds a predetermined value, that is the pressure level downstream the throttle is below a predetermined level, and secondly, the measured period of the engine cycle is below the value determined by the constant potential, that is, the rotational speed of the engine is above a predetermined value. The output signal from the AND gate of terminal 88 then controls the solenoid valve 66 permanently by way of the power amplifier 68, irrespective of the value of the signal from the control means E. The admission of fuel to the idling jet is then interrupted permanently until at least one of the two conditions is no longer fulfilled. The solenoid valve 66 is then controlled again by the signals from the control means E.

Figure 4:
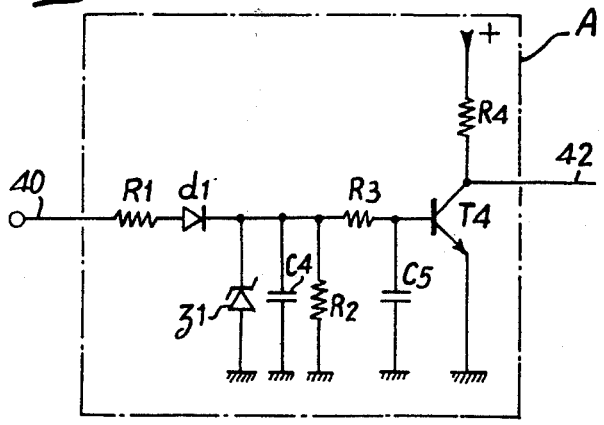
FIG. 4 illustrates schematically one of the elements used in the circuit illustrated in FIG. 3.

FIG. 4 represents the circuit designated A in the block diagram in FIG. 3. The input 40 is connected to a first terminal of a resistor R1 of which the other terminal is connected to the anode of a diode d1. The cathode of the diode d1 is connected to the base of an NPN transistor T4 by a resistor R3. The cathode of a Zener diode z1 is connected to the cathode of the diode d1. The anode of the Zener diode is connected to earth. A capacitor C4 and a resistor R2 are arranged in parallel between the cathode of the diode d1 and earth. Another capacitor C5 is connected between the base of the transistor T4 and earth. The transistor T4 has its emitter connected directly to earth, whereas its collector is connected to a positive potential source by a resistor R4. The output terminal 42 of the circuit A is connected directly to the collector of the transistor T4.

The circuit A operates as follows. The signals received at the input terminal 40 represent the rotational speed of the engine. On these signals are superimposed oscillations due to the operation of the ignition coil. The positive and negative voltages at the input 40 are limited by the resistor R1, diode d1 and Zener diode z1 so as to shape the signal received at the connection 40. The capacitor C4 and resistor R2, arranged in parallel, constitute a filter network which eliminates the surges from the leading and trailing edges of the voltage steps delivered at the cathode of the Zener diode z1. The resistor R3 and capacitor C5 constitute a second filter network which can also match the currents at the input of the transistor T4. At the collector of the transistor T4, that is, at the connection 42, voltage steps are delivered whose repetition frequency equals the number of ignitions per second, that is, twice the number of engine revolutions per second in the case of a four-cylinder engine. The frequency of repetition of the voltage steps delivered at the connection 42 would of course equal the number of engine revolutions per second in the case of a two-cylinder engine and would be three times the number of engine revolutions per second in the case of a six-cylinder engine.

The circuit B mentioned above is a frequency divider of a type known in the logic circuitry art, and will not be described here. Such a circuit is necessary because the distributors used on vehicles cannot ensure that for a four-cylinder engine, for example, the duration of an engine cycle is divided precisely into four equal periods. Since the measurement of the variations in engine speed is effected by comparing successive periods, it is preferable for this measurement to be carried out on a complete engine cycle to give good measuring accuracy. The circuit B therefore delivers pulses whose frequency corresponds to the duration of a complete engine cycle. These are obtained by dividing the frequency of the signal from the platinum tipped screws by four in the case of a four-cylinder engine. Obviously, the frequency divider B would divide the frequency by two in the case of a two-cylinder engine and by six in the case of a six-cylinder engine. The signal delivered at the connection 44 could equally well be obtained from one of the sparking plug leads of the engine, duly shaped. As already mentioned, the signal delivered by the divider B preferably corresponds to the duration of an engine cycle, but the division ratio could, for example, for a four-cylinder engine, be a submultiple or multiple of four, corresponding respectively to measurement of the duration of part of an engine cycle or of a plurality of successive engine cycles.

Figure 5:
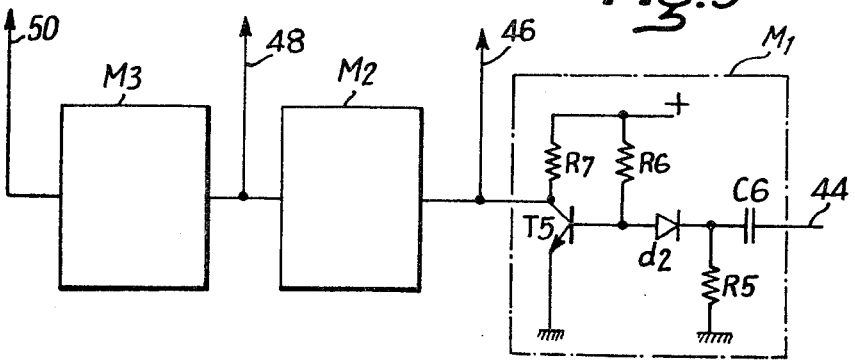
FIG. 5 illustrates schematically another of the elements used in the circuit illustrated in FIG. 3.

FIG. 5 shows the details of the circuit C. As already stated, it comprises three monostable circuits M1, M2 and M3 arranged in series and identical in structure. Only the monostable circuit M1 will be described. It comprises an input capacitor C6 of which one end is linked to the connection 44 whereas the other end is linked to the base of an NPN transistor T5 by a diode d2. The diode d2 is conductive from the base of the transistor T5 towards the corresponding end of the capacitor C6. A resistor R5 is situated between the other end of the capacitor C6 and earth. Another resistor R6 is provided between the base of the transistor T5 and a positive voltage source. The emitter of the transistor T5 is connected directly to earth, and the collector of this transistor is connected to the positive voltage source by a resistance R7. The output terminal of the monostable circuit M1 is formed by the collector of the transistor T5. The output 46 of the monostable circuit M1 is connected to the input capacitor (not shown) of the monostable circuit M2, and the output terminal 48 of the monostable circuit M2 is connected to the input capacitor (not shown) of the monostable circuit M3. The circuit shown in FIG. 5 operates as follows. When the signal on the connection 44 presents a trailing edge, the capacitor C6 transmits to the cathode of the diode d2 a negative pulse whose amplitude is substantially equal to the amplitude of the trailing edge on the connection 44. A negative potential is then applied to the base of the transistor T5 by way of the diode d2 to block the transistor T5, which was, prior to that instant, conductive. The voltage at the collector of the transistor T5, that is at the output terminal 46, becomes positive. The capacitor C6 is then recharged by the resistances R6 and R5 until the voltage at the base of the transistor T5 is such that the latter becomes conductive again. The voltage at the collector of the transistor T5 falls back to zero. The positive signal which has been delivered at the output terminal 46 is the first closing signal mentioned above. The falling edge of the first closing signal in turn triggers the monostable circuit M2 to produce a positive signal of given duration at the latter's output terminal 48. This latter positive signal is the second closing signal mentioned above. The trailing edge of this closing signal in turn triggers the monostable circuit M3 to deliver at its output terminal 50 a positive signal which is the third closing signal mentioned above. It will be appreciated that the first, second and third closing signals succeed one another in that order in response to the triggering of the monostable circuit M1 by a trailing edge delivered on the connection 44. The durations of the first, second and third closing signals are determined respectively by the time constants of the first, second and third monostable circuits M1, M2, M3. These durations are negligible in value, compared with the duration of the period of time between two successive negative going edges on the connection 44.

Figure 6:
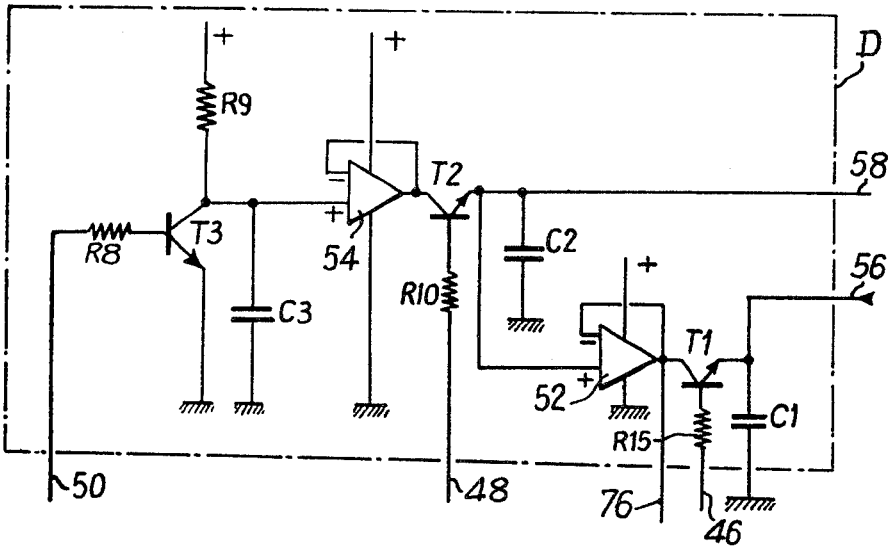
FIG. 6 illustrates schematically still another of the elements used in the circuit illustrated in FIG. 3.

FIG. 6 represents the circuit D in the block diagram in FIG. 3. This circuit has three normally open switches T1, T2 and T3 controlled respectively by the closing signals at the output terminals 46, 48 and 50. The switches T1, T2 and T3 are formed by NPN transistors whose bases receive the first, second and third above mentioned closing signals by way of respective resistances R15, R10 anmd R8. The emitter of the transistor T3 is connected directly to earth, and its collector is connected to a positive voltage source by a resistance R9. Between the collector of the transistor T3 and earth is disposed a capacitor C3. The collector of the transistor is connected to the positive input of a coupling amplifier 54. The output of the amplifier 54 is connected to its negative input to form a unity gain stage. The output of the amplifier 54 is connected to the collector of the transistor T2. The emitter of the transistor T2 is connected both to earth, by way of a capacitor C2, and directly to the positive input of a unity-gain coupling amplifier 52. As in the case of the amplifier 54, the output of the amplifier 52 is connected to its negative input. The output of the amplifier 52 is connected to the collector of the transistor T1. The emitter of the transistor T1 is connected to earth by a capacitor C1.

The circuit D has three output terminals 56, 58 and 76. The output terminal 56 is connected directly to the emitter of the transistor T1, and the outut terminal 58 is connected directly to the emitter of the transistor T2. Thus the signals at the output terminals 56, 58 consist respectively of the charges of the capacitors C1, C2. The third output terminal 76 is the output terminal of the amplifier 52, as mentioned in the description relating to FIG. 3.

The device in FIG. 6 operates as follows. When the first, second and third closing signals are generated in that order, as explained with reference to FIGS. 3 and 5 of the drawings, the transistor T1 is first rendered conductive upon delivery of the first closure signal, and the charge then contained in the capacitor C2 is transferred to the capacitor C1 by way of the amplifier 52 and the emitter/collector circuit of the transistor T1. The latter is blocked again at the end of the first closure signal. The second closure signal then appears and renders the transistor T2 conductive so as to transfer the charge contained in the capacitor C3 to capacitor C2 by way of the amplifier 54 and the emitter/collector circuit of the transistor T2. The transistor T2 is blocked again at the end of the second closing signal, and the transistor T3 becomes conductive in response to the delivery of the third closing signal. The charge of the capacitor C3 is then reset to zero. At the end of the third closing signal, the capacitor C3 begins to charge again in accordance with an exponential law whose time constant is R9C3. Operation is repeated in an identical manner in response to the delivery to the connection 44 of another negative going edge, which triggers the monostable circuits M1, M2 and M3 successively. As already explained, the two signals available at the terminals 56, 58 respectively represent the periods of two successive engine cycles, the period corresponding to the charge of the capacitor C1 preceding the period corresponding to the charge of the capacitor C2.

Figure 7:
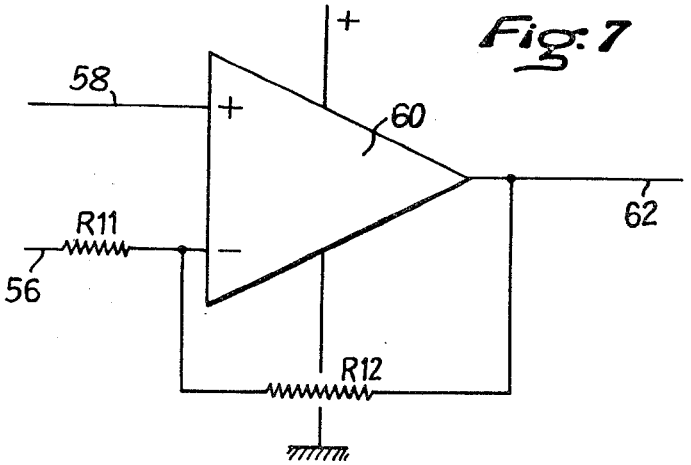
FIG. 7 illustrates schematically another of the elements used in the circuit illustrated in FIG. 3.

FIG. 7 represents the differential amplifier 60 shown in FIG. 3, of which the positive input is connected directly to the output terminal 58 of the circuit D and the negative input is connected to the output terminal 56 of the circuit D by way of a resistance R11. A resistance R12 is connected between the output terminal 62 of the amplifier 60 and its negative input. The ratio between the resistances R12 and R11 determines the gain of the amplifier 60.

The amplifier 60 operates as follows. If the signals at the output terminals 56, 58 of the circuit D are identical, this means that the period has not varied between two successive engine cycles, and therefore that the rotational speed of the engine is constant. The signal at the output terminal 62 assumes a medium value.

If the rotational speed of the engine decreases, the duration of the periods of successive cycles increases and the charge of C2 is greater than that of C1. In this case the output 62 of the amplifier 60 assumes a value greater than the medium value mentioned above.

If, however, the rotational speed of the engine increases, the duration of the periods of the successive cycles decreases, and the charge of C2 is lower than that of C1. The output 62 of the amplifier 60 then assumes a value lower than the medium value.

To summarize, the absolute value, that is the amplitude, of the signal at the output terminal is an increasing function of the variations in the duration of an engine cycle, i.e., a decreasing function of the variations in the engine rotational speed.

Figure 8:
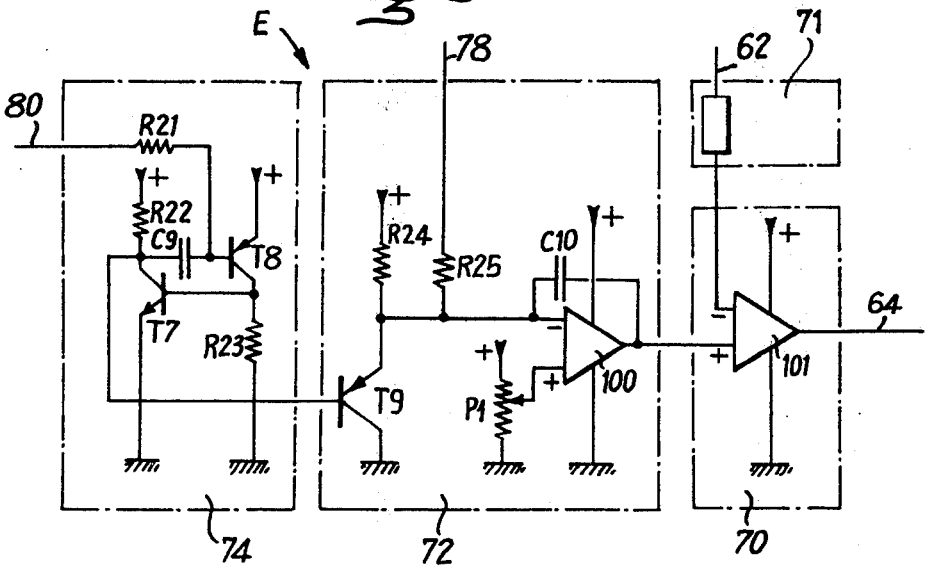
FIG. 8 illustrates schematically another of the elements used in the circuit illustrated in FIG. 3.
Figure 9:
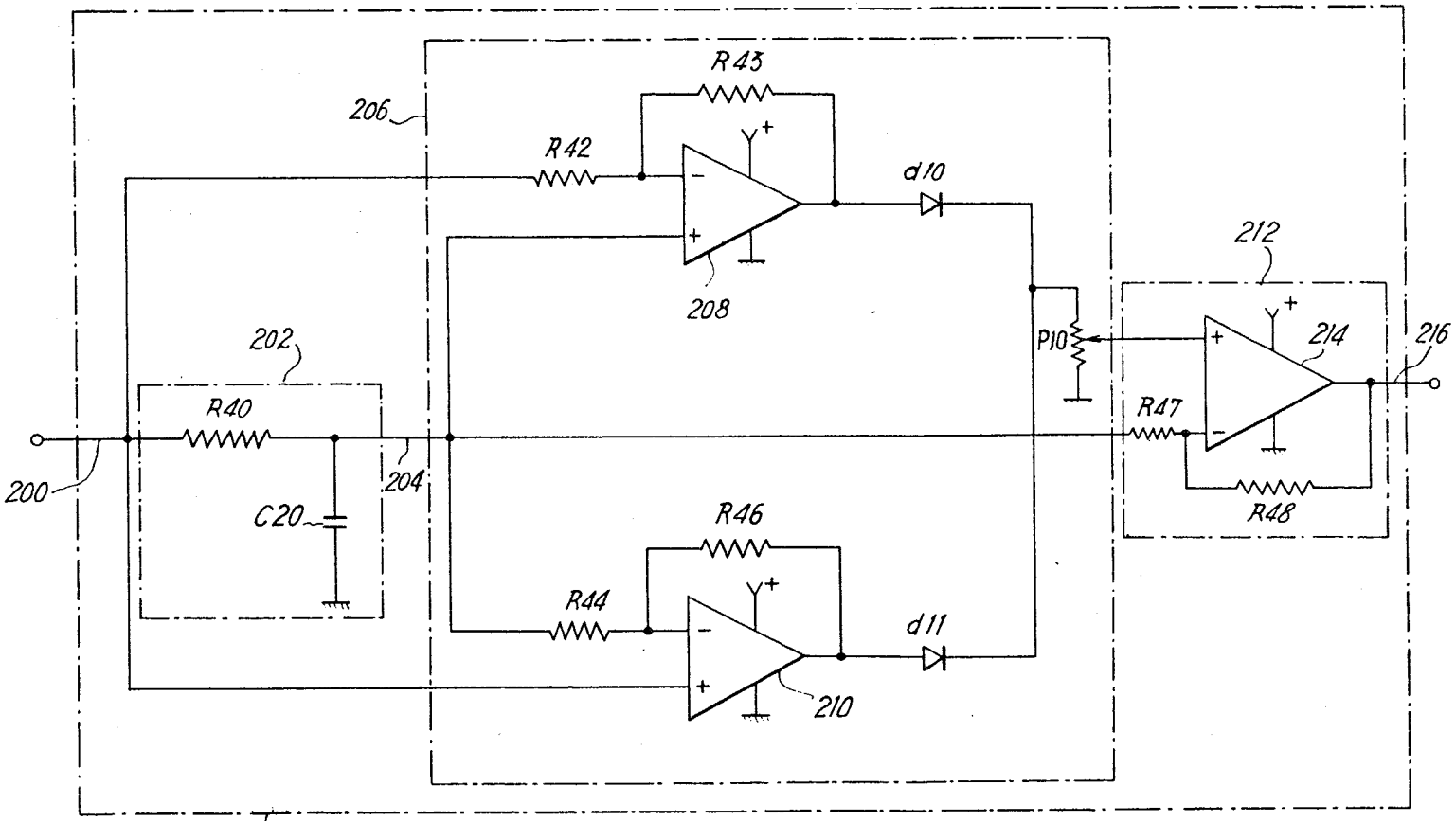
FIG. 9 illustrates schematically another of the elements used in the circuit illustrated in FIG. 3.

FIGS. 8 and 9 represent an embodiment of the control circuit E in FIG. 3, comprising the subcircuits 70, 71, 72 and 74. The subcircuit 70 in FIG. 8 constitutes the output stage of the control means and comprises a high-gain differential amplifier 101 whose positive input terminal is connected to the output of the subcircuit 72 and whose negative input terminal is connected to the output terminal 62 of the amplifier 60 by way of the circuit 71 (described below). The output signal from the control circuit E is delivered at the output terminal of the differential amplifier 101, which here acts as a comparator.

The circuits 72, 74 consist respectively of a sawtooth signal generator and an oscillator whose frequency controls that of the sawtooth signals. The oscillator 74 has an input terminal 80 connected to the output terminal 84 of the correcting circuit F. A resistance R21 connects the terminal 80 to the base of a PNP transistor T8, of which the emitter is connected directly to a positive voltage source and the collector is connected to earth by a resistance R23. The collector of the transistor T8 is directly connected to the base of an NPN transistor T7, of which the emitter is connected directly to earth and the collector is connected to a positive voltage source by a resistance R22. The value of the resistance R22 is substantially less than that of the resistance R21, for reasons to be explained when the operation of the control circuit is described. By way of example, R21 may have a value of 330 kOhms and R22 a value of 33 Ohms. A capacitor C9 connects the collector of the transistor T7 to the base of the transistor T8. The output terminal of the oscillator is the collector of the transistor T7. It is connected directly to the base of a PNP transistor T9, this base being the input terminal of the sawtooth signal generator 72. The collector of the transistor T9 is connected directly to earth, and its emitter is connected to a positive voltage source by way of a resistance R24. The emitter of the transistor T9 is also connected to the negative input terminal of an operational amplifier 100 whose positive input is connected to a positive voltage source, the voltage being supplied by a potentiometer P1. A capacitor C10 is connected to provide negative feedback between the output terminal and the negative input of the amplifier 100. The output of the amplifier 100 is the output terminal of the sawtooth signal generator. The negative input of the amplifier 100 is also connected to the terminal 78, that is, the output terminal 76 of the amplifier 52, by way of a resistance R25.

FIG. 9 shows the circuit 71 from FIG. 3 in more detail. The circuit has an input 200 connected to the output 62 of the amplifier 60 and also forming the input terminal of a first subcircuit 202, termed the averaging circuit, designed to deliver at its output terminal 204 a signal representing the average of the signal from the amplifier 60. The subcircuit 202 is of the resistance/-capacitor type, comprising a resistance R40 of which one end is connected to the input 200 and also comprising a capacitor C20 connected between the other end of the resistance R40 and earth. The output terminal 204 is formed by the common terminal of the resistance R40 and capacitor C20. The circuit 71 also includes a rectifying circuit 206 responsive to the signal from the terminal 200. The rectifying circuit 206 has a first path, termed the "non-inverting path", which responds to the signal at the input terminal 200 so as to amplify this signal so that only the part of the difference between this signal and the signal representing the average is amplified with a given positive gain. Note that amplification occurs irrespective of the polarity of the difference, that is to say, both positive and negative differences are amplified with the same positive gain. The non-inverting path of the circuit 206 essentially comprises an operational amplifier 210 of which the negative input is connected to the output terminal 204 of the circuit 202 by a resistance R44 and of which the noninverting input terminal is connected to the terminal 200. A resistance R46 is connected between the output terminal and the inverting input terminal of the amplifier 210.

The rectifying circuit also comprises a second path, termed the "inverting path", which also responds to the signal at the input terminal 200, which it amplifies so that only the difference between this signal and the signal representing the average is amplified with a negative gain whose absolute value equals that of the given positive gain. For example, assuming that the given positive gain has the value + 2, the given negative gain has the value − 2. If, therefore, the signal at the terminal 200 presents a negative difference having a value equal to 1 volt with respect to the signal representing the average, the signal delivered by the inverting path then presents a positive difference with respect to the signal representing the average, said positive difference having a value equal to 2 volts. The inverting path consists essentially of an operational amplifier 208 of which the inverting input is connected to the terminal 200 by a resistance R42 and the non-inverting input is connected to the terminal 204. Also, the output of the amplifier 208 is connected to its inverting input terminal by a resistance R43.

Note that the gain of the non-inverting path is determined by the relative values of the resistances R44, R46, and the gain of the inverting path is determined by the relative values of the resistances R42, R43. A diode d10 is connected in the forward sense to the output from the operational amplifier 208, and a diode d11 is connected, also in the forward sense, to the output from the operational amplifier 210. The two diodes d10, d11 are connected to one end of a potentiometer P10 whose other end is connected to earth so that an output signal is delivered by said potentiometer P10. As a result, because of the diodes d10, d11, the output signal from the circuit 206 equals the greater of the signals delivered by the inverting and non-inverting paths. In other words, the signal delivered by the circuit 206 presents a difference with respect to the signal representing the average, said difference having always the same polarity. The value of this difference is substantially representative of the amplitude of the variation between the duration of two successive engine cycles.

The circuit 71 also comprises a subcircuit 212 termed "offset circuit" consisting essentially of an operational amplifier 214, of which the non-inverting input terminal is connected to the potentiometer P10. The inverting input terminal of this amplifier 214 is connected to the output terminal 204 of the subcircuit 202 by a resistance R47 and to the output terminal 216 of this amplifier 214 by a resistance R48. The output terminal 216 of the operational amplifier 214 also constitutes the output terminal of the circuit 71, and it is connected to the negative input terminal of the amplifier 101 as shown in FIG. 8.

The operation of the control means E just described with reference to FIGS. 8 and 9 will now be described, with reference also to FIG. 10 which illustrates the variation in the electrical signals at various points of the electronic device, as already stated.

It will be first assumed that transistors T8 and T7 are not conductive and that, in response to a decrease of the voltage on the base of transistor T8, the latter becomes conductive. As a result, transistor T7 becomes conductive, which means that the voltage on its collector drops to a low value and a negative pulse is transmitted to the base of transistor T8 thereby rendering the latter more conductive. The transistor T7 becomes in turn more conductive and both transistors T7 and T8 become rapidly saturated and C9 can no longer transmit a voltage drop signal to the base of transistor T8. However, considering the high value of the resistor R21 and the low value of resistor R22, and also considering the gains of transistors T8 and T7, the current in resistance R21 is not sufficient to maintain transistor T7 saturated and the latter is rapidly blocked again whereby the voltage on the collector of transistor T7 again rises to reach a value substantially equal to the voltage supplied at resistor R22.

Thus, it can be seen that a relatively short negative going pulse has been transmitted on the collector of transistor T7. The trailing edge of that negative pulse is a positive step which is transmitted through a capacitor C9 so that the voltage at the base of transistor T8 reaches a maximum value which is greater than that of the supply voltage. After that positive step has been transmitted, the voltage in the capacitor C9 is decreased according to an exponential law, by the current drawn in the resistor R21. It appears that the decrease in the voltage on base of transistor T8 is a function of the voltage transmitted on terminal 80, so that the decrease will occur more rapidly when the voltage level on terminal 80 is lower. The decay in the voltage at the base of transistor T8 so continues until the voltage reaches a value for which transistor T8 tends again to be conductive. From this instant, the circuit operates as above mentioned and this phenomenon is periodically repeated so that sub-circuit 74 generates negative pulses at the collector of transistor T7. It has been verified that the lower is the signal delivered at the input terminal 80, the greater is the frequency of the pulses delivered on collector of transistor T7. Obviously, the oscillator 74 is given here by way of example only, and any oscillator controlled by a voltage and performing the same function would be equally suitable.

The pulse signal delivered at the collector of the transistor T7 is then transmitted to the base of the transistor T9. The latter behaves as an emitter follower for the negative going edge and the "zero level" part of the signal delivered to its base, but as a blocking diode for the positive going edge and the "high level" of that signal. When the negative step of the signal is transmitted to the negative input terminal of amplifier 100, the output of the latter is switched to a high voltage since a positive potential is transmitted from potentiometer P1 to the positive input terminal of amplifier 100. After the negative pulse on the base of transistor T9 has disappeared, the voltage on the negative input terminal of amplifier 100 returns to a value equal to that of the potential at its positive input terminal. Thereafter, the potential on the negative terminal of amplifier 100 has a tendency to be maintained at a potential substantially equal to the potential on its positive input. Thus the currents from resistors R24 and R25 are compensated by a current from capacitor C10 so that the value of the potential at the output terminal of amplifier 100 is linearly decreased so as to generate a sawtooth signal having a negative slope. The value of the slope is determined by the currents in resistors R24 and R25, i.e., the voltages respectively supplied to these resistors. Since the value of the voltage at terminal 78 is varied according to the duration of an engine cycle, it results that the value of the slope of the sawtooth signal can be modulated in accordance with the value of the engine rotating speed. For instance, when the value of the voltage at terminal 78 is relatively high, which means that the engine speed is rather low, the current drawn from capacitor C10 will be great and the slope of the sawtooth signal will be relatively steep. On the contrary, when the value of the voltage at terminal 78 is relatively low, which means that the engine speed is rather high, the current drawn from capacitor C10 will not be so great as above mentioned and the slope of the sawtooth signal will be smoother. In conclusion, the absolute value of the negative gradient of the sawtooth is proportional to the voltage at the input terminal 78. The sawtooth signals now fed to the positive input of the amplifier 101, connected as a comparator, are compared to the signal fed to the negative input of the amplifier 101 from the circuit 71.

The rectifying circuit 71 operates as follows. At the input terminal 200, the signal from the comparator 60 is delivered in the manner described with reference to FIGS. 4 to 7. The formation of this signal is illustrated by the various curves in FIG. 10, in which:

- curve a represents the voltage on the connection 42;
- curve b represents the voltage on the connection 44;
- curve c represents the voltage at the output 46 of the monostable circuit M1;
- curve d represents the voltage at the output 48 of the monostable circuit M2;
- curve e represents the voltage at the output 50 of the monostable circuit M3;
- curve f represents the voltage at the capacitor C3;
- curve g represents the voltage at the capacitor C2;
- curve h represents the voltage at the capacitor C1;
- curve i is a diagram in which are shown in solid lines the voltage at the output from the amplifier 60 and in chain lines the average output voltage from the amplifier 60;
- curve j is a diagram on which is shown in solid lines the voltage at the output of the circuit 206;
- curve k is a diagram in which the voltage at the output terminal 216 is represented by solid lines and the sawtooth voltage at the output terminal of the amplifier 100 is represented by broken lines; and
- curve l represents the voltage delivered at the output terminal 64 of the control circuit.

Curve a represents a pulse signal at the input of the divider B. This signal has a variable frequency proportional to the rotational speed of the engine. Curve b represents the output signal from the divider B, whose frequency is also proportional to the engine's rotational speed. Each negative edge of the signal represented at b triggers the monostable circuit M1 at the instants t1, t4, t7 and t10 to deliver the first closing signal represented at c. This causes a transfer of the charge from capacitor C2 to capacitor C1 as indicated in FIG. 10. Each negative going edge of the first closing signals triggers the monostable circuit M2 at the instants t2, t5, t8 and t11 to deliver the second closing signal and to transfer the charge from capacitor C3 to capacitor C2 as indicated at g. Throughout the duration of the second closing signal, C3 continues to charge slowly. Each negative going edge of the second closing signals (indicated at d in FIG. 10) triggers the monostable circuit M3 at the instants t3, t6, t9 and t12 to deliver the third closing signal and to discharge the capacitor C3, which remains discharged until the end of the third closing signal. When the latter has disappeared, the capacitor C3 charges exponentially until the appearance of the third closing signal in the following cycle.

The signal shown by solid lines in i is the output signal from the comparator 60 and is proportional to the algebraic value of the difference between the signals represented at g and h. As the FIG. shows, when the frequency of the pulses at a increases, i.e. when the rotational speed of the engine increases, C3 charges to a lower value than during the preceding cycle, and the signal at the output 62 of the amplifier 60 is below a medium value. This occurs, for example, from the instant t8 at which the charge transferred to C2 has fallen below the charge transferred to C1 at the instant t7.

In reality, the lag between the first and second closing signals causes a two-stage variation in the output level of the amplifier 60. However, due to the time constants of the circuit which follow, this phenomenon has no effect on the general operation of the electronic device.

Figure 10:
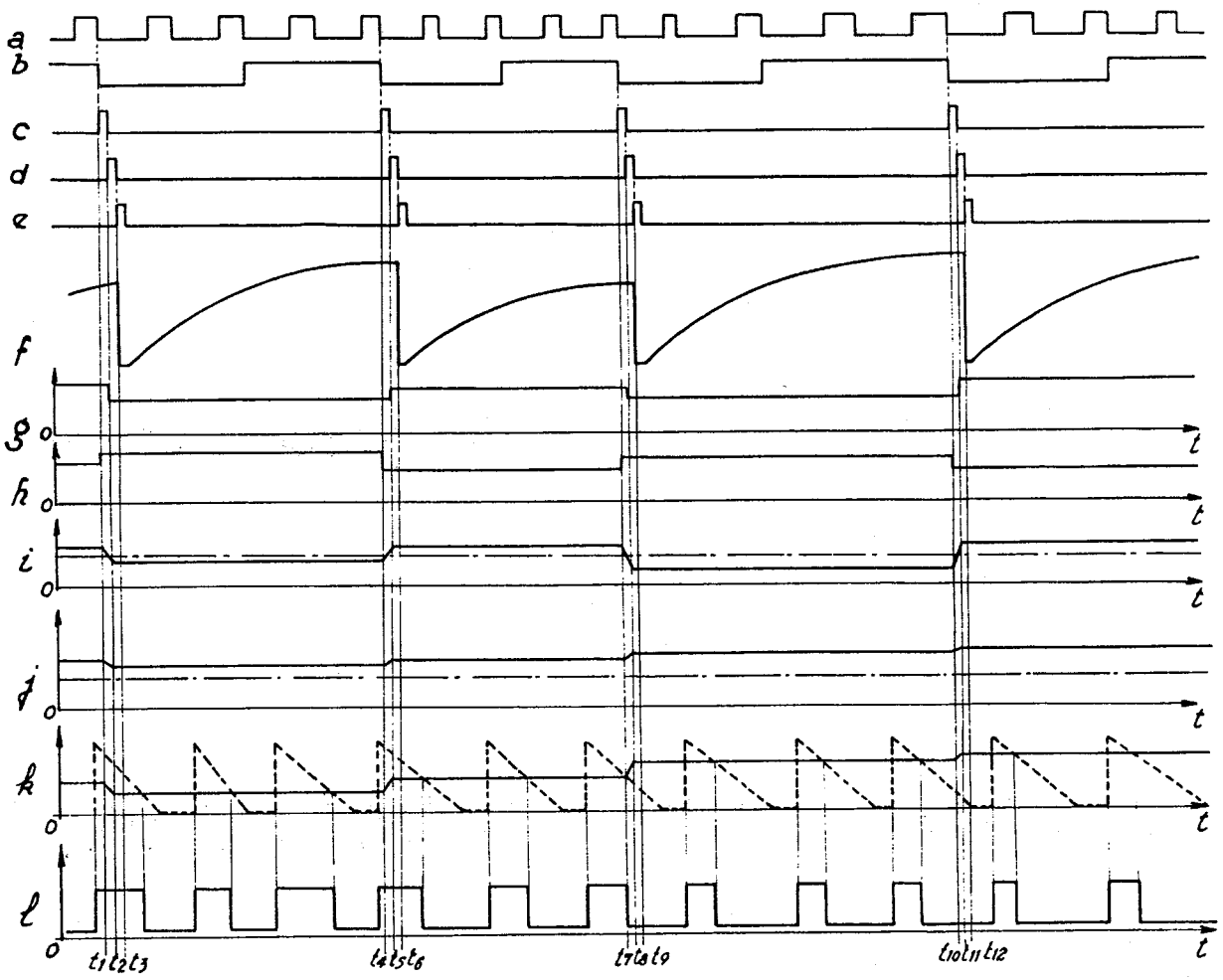
FIG. 10 illustrates the variation in electrical signals in various parts of the electronic device.

In general, the signal from the comparator 60 and represented by the solid curve in diagram i of FIG. 10 can vary about the medium value according to the variations in the value of the engine's rotational speed between two successive engine cycles. If the comparator 60 delivers a signal whose level is above the medium level, the period of an engine cycle has increased, which corresponds to a reduction in the speed of the engine. If, however, the comparator 60 delivers a signal whose level is lower than the medium value, the period of an engine cycle has diminished, and this corresponds to an acceleration of the engine. In practice, the signal from the comparator 60 varies alternately and presents successively periods during which it is above or below the medium value as shown in FIG. 10. This signal is then fed to the input terminal 200 of the circuit 202 to supply at the terminal 204 a signal representing an average value of the signal from the comparator 60. The signal at the input terminal 200 is also fed to the inverting input terminal of the amplifier 208, by way of the resistance R42. On the other hand, the signal from the circuit 202 is fed to the non-inverting input terminal of the amplifier 208 so as to supply it with the signal representing the average. Since the voltages at the respective input terminals of the operational amplifier 208 tend to be equal, and since the voltage at the non-inverting input terminal of the amplifier 208 substantially equals the value of the signal representing the average, the voltage at the inverting input terminal has the same value. If the signal at the input terminal 200 is less than the signal representing the average, current is drawn to the terminal 200, and this current will be supplied from the output terminal of the amplifier 208 by way of the resistance R43. Consequently, the voltage at the output terminal of the amplifier 208 will exceed the average voltage level present at the input terminal. Thus, with reference to the voltage at terminal 204, the voltage difference between the signals at the terminals 200, 204 is inverted and amplified in the ratio of the resistances R43, R42.

As in the case of the operational amplifier 208, the voltage at the input terminals of the operational amplifier 210 tend to be equal. Since the voltage at the non-inverting input terminal of the amplifier 210 is equal to the voltage at the input terminal 200, the result is that the voltage at the inverting input terminal of the amplifier 210 tends to vary identically. On the other hand, the voltage at the end of the resistance R44, which corresponds to the voltage at the input of the circuit 206, equals the voltage of the signal representing the average. If the signal at the noninverting input terminal of the amplifier 210 presents a given difference with respect to the signal representing the average, the signal at its output terminal presents with respect to the same signal a difference amplified in a ratio which is a function of the values of resistances R44 and R46. The signal delivered to the potentiometer P10 by way of the diodes d10, d11 equals the more positive of the respective signals from the inverting and non-inverting paths. This signal is represented by the curve in solid lines in diagram j in FIG. 10.

The "offset" circuit 212 operates as follows. The potentiometer P10 receives a signal whose value equals that of the signal representing the average, plus a certain quantity. On the other hand, one end of the resistance R47 receives the signal representing the average. The potentiometer P10 is set so that the non-inverting input of the amplifier 214 receives a signal equal to half the signal received by the potentiometer P10. As a result, the voltage at the inverting input of the amplifier 214 is also equal to a fixed quantity equal to half the signal representing the average, plus a variable quantity whose amplitude depends on the irregularity of the engine's rotational speed. Since the resistances R47 and R48 are equal, circuit 212 operates in such a manner that the component due to the signal representing the average is eliminated in the signal at the output from the amplifier 214, and only that portion of the signal situated above the average component is maintained and amplified, as shown in FIG. 10. The signal delivered by the circuit 206 is thus offset to zero and amplified by means of the circuit 212. This signal is represented by solid lines in the diagram k in FIG. 10.

To summarize, the amplitude of the signal from the circuit 71 during a given engine cycle is proportional to the absolute value of the difference between the duration of respective periods of the two preceding engine cycles.

The comparator 101 receives both the signal from the circuit 71, at its inverting input terminal, and the sawtooth signal from the amplifier 100, at its non-inverting input terminal. The output signal at the terminal 64 is then formed by a train of pulses supplied between the instants corresponding to the first and second intersections of the input signals of the comparator 101, that is, when the sawtooth signal is greater than the signal from the circuit 71. This output signal corresponds to the control signal for the solenoid valve and is represented by the curve l in FIG. 10. The greater is the level of the signal from the circuit 71, the shorter the cut-off pulses from comparator 101 will be. Since this level is proportional to the absolute value of the variation in period of an engine cycle, i.e. to the irregularity of the engine, the result for an engine whose carburettor is already supplied with a sufficiently poor air/fuel mixture, i.e. an engine whose speed of rotation is already quite irregular, is that the cutoffs in the admission of mixture will be few in number and of short duration, as the circuit 71 then delivers a large-amplitude signal.

However, in the case of an engine receiving too rich a mixture, i.e. having a regular rotational speed, the circuit 71 delivers a signal of smaller amplitude. This results in cutoff pulses of longer duration, and consequently in a reduction in fuel consumption and an increase in the irregularities of the engine, the latter being maintained, however, at an acceptable level. Note also that the averaging circuit 202 of the rectifying circuit 71 could be omitted without departing from the scope of the invention. This circuit, which serves to compensate for slight variations in the average value of the signal at the output of amplifier 60, could be replaced with a voltage generator supplying a signal of constant value approximating to the medium value, without fundamentally modifying the operation of the circuit 71. Similarly, the zero suppression circuit is provided to adjust the "zero" level of the signal from the potentiometer P10 with the "zero" level of the sawtooth signal, but it is also possible to generate a sawtooth signal which is then reset with respect to the level of the signal from the potentiometer P10.

The width and frequency of the pulses delivered by the amplifier 101, that is the duration and number of cutoffs of admission, depend also on the values of the gradient and frequency of the sawtooth signals, these values being modified according to the operating conditions of the engine. An increase in the absolute value of the gradient of the sawtooth signals corresponds to shorter durations of cutoff, and an increase in their frequency corresponds to more numerous cutoffs.

Note also that, similarly, a generator could be used which supplies sawtooth signals with alternately positive and negative slopes, or slopes varying in a non-linear (for example exponential) fashion, instead of the sawtooth signal generator just described.

Figure 11:
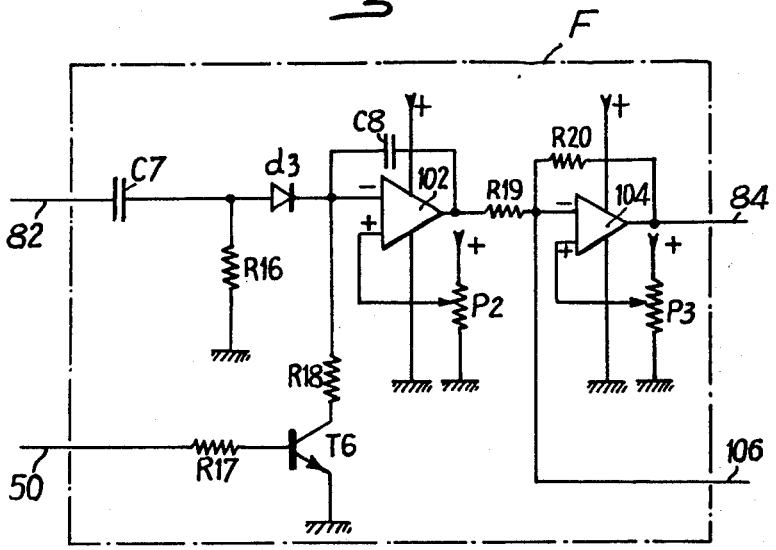
FIG. 11 illustrates schematically another of the elements used in the circuit illustrated in FIG. 3.

FIG. 11 illustrates an embodiment of the correcting circuit F shown in the block diagram in FIG. 3. This circuit is adapted to deliver a signal for controlling the value of the frequency of the signal delivered by the oscillator 74. The output terminal 82 of the correcting circuit f receives the output signal from the amplifier 60, which represents the variations in duration of a period of the engine cycle. The input terminal 82 is connected to the first end of a capacitor C7, of which the second end is connected to the anode of a diode d3. The cathode of the diode d3 is connected to the negative input of a differential amplifier 102. A capacitor C8 is connected to provide negative feedback between the output and the negative input of the amplifier 102 which is therefore mounted as an integrator. The positive input is connected to the positive voltage source formed by a potentiometer P2. The output of the amplifier 102 is connected to the negative input of a differential amplifier 104. A resistance R20 is provided between the output and the negative input of the amplifier 104. The positive input terminal of the amplifier 104 is connected to a positive voltage source formed by a potentiometer P3. The output of the amplifier 104 constitutes the output terminal 84 of the correcting circuit F.

The correcting circuit F also comprises an input terminal connected to the output terminal 50 of the monostable circuit M3. This input terminal is connected to the base of an NPN transistor T6 by a resistance R17. The collector of the transistor T6 is connected to the negative input of the amplifier 102 by a resistance R18. The emitter of the transistor T6 is connected directly to earth. A connection 106 is also connected to the negative input of the amplifier 104; its role will be explained below. The correcting circuit F just described with reference to FIG. 11 operates as follows. The signal received at the input terminal 82 from the output terminal 62 of the amplifier 60 is a signal which varies in steps. The direction and amplitude of the variation in level of this signal depend on the variations in period between two successive engine cycles, as explained above. The signal at the input terminal 82 is then differentiated by the circuit comprising the capacitor C7 and resistance R16. At the anode of the diode d3, a train of positive and negative pulses is delivered whose amplitudes are proportional to the amplitudes of the corresponding variations in period. The diode d3 eliminates the negative pulses, and consequently the amplifier 102 takes into account only the pulses corresponding to increases in period of the engine cycle, that is, reductions in the rotational speed. The greater the number and amplitude of the positive pulses, the lower is the output level of the amplifier 102. The amplifier 104 forms a matching stage which enables the correcting circuit to deliver a signal compatible with the control circuit. It will be appreciated that a high level at the output of the amplifier 104 corresponds to a low level at the output of amplifier 102, and that a low level at the output of amplifier 104 corresponds to a high level at the output of amplifier 102. There is a reduction in the frequency of the oscillator 74 and of the sawtooth signal from the generator 72, that is, a reduction in the occurrence of signals to close the solenoid valve, and consequently greater admission of the air/fuel mixture. To summarize, the fewer the irregularities of the engine, the higher is the frequency of the oscillator, that is, the greater is the number of cutoffs, which means that the mixture is poorer and operation is closer to the ideal.

The transistor T6 is periodically rendered conductive by the third closing signal from the output terminal 50 of the monostable circuit M3, to draw some current in the resistance R18 thereby compensating for the pulses transmitted by d3 to produce a state of equilibrium at the output of the amplifier 102, so that the voltage at the output terminal of amplifier 102 does not remain permanently at a low level.

Figure 12:
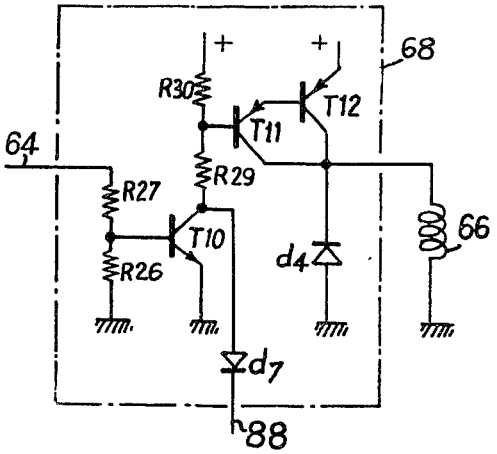
FIG. 12 illustrates schematically another of the elements used in the circuit illustrated in FIG. 3.
Figure 13:
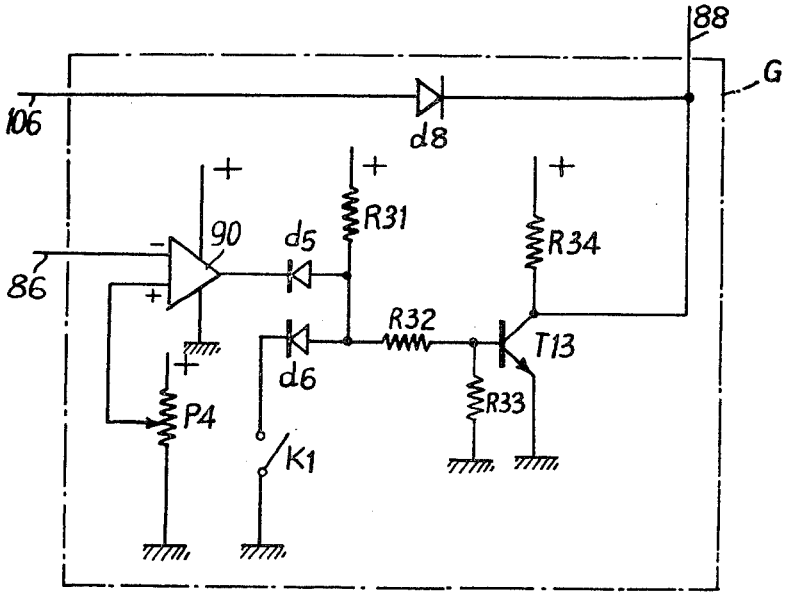
FIG. 13 illustrates schematically still another of the elements used in the circuit illustrated in FIG. 3.

FIG. 12 represents the power amplifier 68 which supplies the signal controlling the solenoid valve 66. The power amplifier has a resistive divider consisting of the resistances R26 and R27. One end of the resistance R27 is connected to the output terminal 64 of the control circuit E. One end of the resistance R26 is connected to earth. The common end of the resistances R26, R27 is connected directly to the base of an NPN transistor T10, of which the emitter is connected directly to earth and the collector is connected to a positive voltage source by way of resistances R29, R30 connected in series. The intermediate point between the resistances R29, R30 is connected to the base of a PNP transistor T11. The transistor T11 is associated with a PNP transistor T12 to form a Darlington amplifier circuit, well known in the low frequency amplifier art. The output of the amplifier circuit is formed by the collectors of the transistors T11 and T12, which are interconnected. The output signal from the amplifier 68 controls the solenoid valve 66.

A diode d4 is provided between the collectors of the transistors T11 and T12 and earth, with its anode connected to earth.

In addition, the collector of the transistor T10 is connected to the anode of a diode d7, whose cathode is connected to the output terminal 88 of the cutoff circuit. As will be later seen, transistor T10 and diode d7 act as an OR gate.

The operation of the amplifier 68 just described will now be explained, omitting the diode d7 whose role will be explained below with reference to the operation of the cutoff circuit. When a control signal is delivered at the output terminal 64 of the control circuit E, transistor T10 becomes conductive, and the voltage at the base of the transistor T11 reduces to render the transistors T11, T12 conductive and to supply a control pulse to the coil of the solenoid valve 66. The diode d4 protects the transistors T11, T12 from surges produced at the terminals of the coil 66 at the moment when the control current for the solenoid valve 66 is cut off. FIG. 14 illustrates an embodiment of the cutoff circuit G. The terminal 86 is connected to the connection 78. A high-gain differential amplifier 90 has a negative input terminal connected to the input terminal 86 and a positive input terminal connected to a positive voltage source consisting of a potentiometer P4. The amplifier 90 is connected as an open loop and behaves as a comparator. The output from the amplifier 90 is connected to the cathode of a diode d5 whose anode is connected to a positive voltage source by a resistance R31. A diode d6 is connected by its anode to the diode d5 and by its cathode to earth by way of a switch K1, which opens only when the depression detected downstream of the throttle exceeds a predetermined value. In a preferred embodiment, the switch K1 is controlled by a bellows mounted in the inlet manifold of the engine, downstream of the throttle. A point connecting the anodes of the diodes d5, d6 is connected to the base of an NPN transistor T13 by a resistance R32. A resistance R33 is provided between the base of the transistor T13 and earth. The emitter of the transistor T13 is connected to earth, and its collector is connected to a positive voltage source by a resistance R34. The collector of the transistor T13 is connected both directly to the output terminal 88, and by way of a diode d8 to the connection 106 from the negative input of the amplifier 104. The cutoff circuit just described operates as follows. Initially, we shall assume that the depression downstream of the throttle exceeds the predetermined value, i.e. the switch K1 is open, and that the rotational speed of the engine exceeds a value determined by the voltage of the potentiometer P4. As long as the rotational speed of the engine exceeds the given value, the logic signal at the cathode of the diode d5 is at a high level. Since the switch K1 is open, the cathode of the diode d6 is also at a high level. The diodes d5, d6 act as an AND gate, and the signal delivered to the base of the transistor T13 is then high. The transistor T13 is conductive, and the voltage at the output terminal 88 is low. Closure of the solenoid valve 66 is then directly controlled by way of the diode d7 and by way of the amplifier stages formed by the transistors T11, T12 (FIG. 10) whatever the signal on terminal 64. This occurs as long as the switch K1 remains open and the engine speed exceeds the value to which the potentiometer P4 is set. The transistor T10 and the diode d7 of the power amplifier 68 form an OR gate as mentioned above. The signal delivered at this terminal overrides the signal from the control means as long as the voltage at the output terminal 88 is low, and the solenoid valve is then closed. This situation continues until the instant at which one of the signals at the cathodes of the diodes d5 and/or d6 changes to a low level, that is, until the moment at which the rotational speed falls below the value to which the potentiometer P4 is set during a deceleration period, or the moment at which the depression downstream of the throttle falls below the predetermined value.

From this instant the signal at the output terminal 88 is high, and the solenoid valve 66 is normally controlled by the control circuit until the signal at the output terminal 88 returns to a low level.

The diode d8 situated between the collector of the transistor T13 and the negative input of the amplifier 104 (FIG. 9) brings the potential of this negative input to a level close to zero when the switch K1 is open and when the rotational speed of the engine exceeds a predetermined value. The diode d8 prevents the potential from resuming a high level at the end of the signal delivered at the terminal 88. This ensures that at the end of a cutoff period controlled by circuit G, there is a low level at the output from the amplifier 102 (FIG. 9), that is, a reduction in the frequency of the signals delivered by the control circuit, i.e. minimal cutoff.

It should be noted that the expression "controlling the admission of the air-fuel mixture" should be interpreted in a broad sense and applies to systems in which the solenoid valve cuts off the supply of fuel upstreams of the place where the mixture is formed. In the latter case, a mixture of air and fuel can be obtained only when some fuel is admitted towards the engine. If the fuel admission is cut off, it is clear that the admission of the air-fuel mixture is cut off, since only air is then admitted to the engine.

We claim:

1. In a carburetor comprising an idle and low speed circuit a control valve mounted in said circuit for controlling admission of fuel-air mixture in said circuit, first means for generating a first signal the amplitude of which is representative of the amplitude of the variations between the durations of two engine cycles, and second means for generating a control signal for controlling said valve to modulate admission of said fuel-air mixture, said second means being responsive to said first signal for generating said control signal whose duration decreases as a function of the level of said first signal.

2. The carburetor of claim 1, wherein:

said control valve is adapted to be closed upon generation of said control signal;

said second means for generating said control signal comprises first comparing means for comparing said first signal with a second signal, said second signal being substantially periodic; and said first comparing means generates said control signal during a period of time comprised between the first and second interaction of said first and second signals within a period of said substantially periodic signal.

3. The carburetor of claim 2; wherein said first comparing means generates said control signal whenever said second signal has a value greater than said level of said first signal.

4. The carburetor of claim 1;

said second means for generating a control signal being further responsive to the magnitude of a signal representative of the duration of an engine cycle for modifying the duration of said control signal to cause a decrease in the duration of said control signal in response to an increase of the duration of said engine cycle.

5. The carburetor of claim 1;

said second means for generating a control signal being further responsive to the occurrence of the variations of the magnitude of a signal representative of the relative variations between the duration of two engine cycles for modifying the rate of change of the control signal so that the rate of change of said control signal is a decreasing function of the number of occurrences of the variations of said magnitude.

6. The carburetor of claim 1;

said second means for generating a control signal being responsive to the amplitude of the variations of the level of a signal representative of the relative variations between the duration of application of two engine cycles for modifying the rate of change of said control signal so that the rate of said control signal is a decreasing function of the amplitude of the variations of said level.

7. The carburetor of claim 1, said first means including second comprising means adapted to receive second and third signals respectively representative of the duration of two engine cycles, said second comparing means delivering a signal which is a function of the difference between said second and third signals, rectifying means responsive to the difference function signal for rectifying said last named signal with respect to a given magnitude of the difference function signal.

8. The invention of claim 7, and means for generating said given level, said last mentioned means being responsive to the difference function signal for delivering an output signal equal to the average value of said difference function signal, said output signal corresponding to said given magnitude of the difference function signal.

9. The carburetor of claim 7, said second and third signals being representative of the duration of two successive engine cycles.

10. Control circuit for generating a control signal adapted to close a normally open valve disposed in the idle and low speed circuit of a carburetor for an engine, said control circuit comprising:

first means for generating a first signal representative of the amplitude of the variations between the durations of two successive engine cycles, second means for generating a substantially periodic second signal, first comparing means for comparing said first and second signals and for delivering said control signal whenever said first and second signals are in a predetermined relationship, the duration of said control signal being a decreasing function of the value of said first signal.

11. The control circuit of claim 10, wherein said first means comprise means for generating a third signal representative of the relative variations between the duration of two succesive engine cycles, and rectifying means responsive to said third signal for generating a signal rectified with respect to a given level, said rectified signal being said first signal.

12. The control circuit of claim 11, said rectifying means comprising averaging means responsive to said third signal for delivering a fourth signal representative of said given level, a rectifying circuit responsive to said third and fourth signals, said rectifying circuit including an inverting path and a non-inverting path, said rectifying circuit being adapted to deliver an output signal corresponding to either of the signals supplied by the inverting and non-inverting paths, said output signal having a representative curve always on the same side of the curve representative of the fourth signal.

13. The control circuit of claim 12, and offset means responsive to the signal delivered by the rectifying circuit for resetting said last named signal to a zero level.

14. The control circuit of claim 10 and means for generating a third signal representative of the relative variations between the duration of two successive engine cycles, correcting means for acting on said second means, said correcting means being responsive to the number of occurrences in the variations of said third signal for causing a decrease in the frequency of said second signal when the number of said occurrences increases.

15. The control circuit of claim 14, said correcting means being also responsive to the amplitude in said variations of the third signal for augmenting the decrease in the frequency as a function of the amplitude of said variations of the first signal.

16. The control circuit of claim 10, said second means including a sawtooth generator for supplying said second signal.

17. The control circuit of claim 16, said second means including oscillator means for controlling the frequency of the sawtooth generator, said oscillator means being of voltage-controlled type, correcting means responsive to the number of occurrences and to the amplitude of the variations in a signal represenative of the relative variations between the duration of two successive engine cycles for delivering a signal acting on said oscillator means so as to cause a decrease in the frequency of said latter means proportionally to the number of occurrences and amplitude of said variations.

18. The control circuit of claim 11, said means for generating said third signal comprising second comparing means adapted to receive input signals respectively representative of the durations of two successive cycles for generating said first signal, said first signal being a function of the difference between the two input signals.

19. The control circuit of claim 18, and first and second storage means for respectively storing the input signals, and first switch means for transferring a signal from the first storage means into the second storage means, second switch means for subsequently transferring into the first storage means a signal representative of the duration of the last measured engine cycle.

20. The control circuit of claim 19, and first and second control means for respectively controlling said first and second switch means, said first and second control means being formed of two monostable circuits mounted in series.

* * * * *